US010837155B2

(12) United States Patent
Hawkinson

(10) Patent No.: US 10,837,155 B2
(45) Date of Patent: Nov. 17, 2020

(54) EROSION CONTROL SYSTEM

(71) Applicant: Robert Neal Alfred Hawkinson, Orange Park, FL (US)

(72) Inventor: Robert Neal Alfred Hawkinson, Orange Park, FL (US)

( * ) Notice: Subject to any disclaimer, the term of this patent is extended or adjusted under 35 U.S.C. 154(b) by 0 days.

(21) Appl. No.: 16/567,527

(22) Filed: Sep. 11, 2019

(65) Prior Publication Data

US 2020/0080272 A1 Mar. 12, 2020

Related U.S. Application Data

(60) Provisional application No. 62/730,237, filed on Sep. 12, 2018.

(51) Int. Cl.
*E02D 17/20* (2006.01)
*E02B 3/04* (2006.01)

(52) U.S. Cl.
CPC ..... *E02D 17/202* (2013.01); *E02B 3/04* (2013.01); *E02D 2300/0009* (2013.01); *E02D 2300/0085* (2013.01)

(58) Field of Classification Search
CPC ..... E02D 17/20; E02D 17/202; E02D 31/00; E02D 31/002; E02D 31/06; E02D 2300/0085; E02D 29/0291; E02B 3/04; E02B 3/12; E02B 3/122; E02B 3/127; E04D 2013/0813; A01G 13/0256; A01G 13/0268
See application file for complete search history.

(56) References Cited

U.S. PATENT DOCUMENTS

| | | | | |
|---|---|---|---|---|
| 3,922,832 | A | 12/1975 | Dicker | |
| 6,186,701 | B1 * | 2/2001 | Kempers | E02B 3/127 405/19 |
| 7,452,165 | B2 * | 11/2008 | Tyler | E02B 3/125 405/302.6 |
| 7,811,028 | B1 | 10/2010 | de la Rosa et al. | |
| 8,777,523 | B2 | 7/2014 | Stephens et al. | |
| 9,163,373 | B2 * | 10/2015 | Bradley, Sr. | E02B 3/127 |
| 9,562,350 | B1 * | 2/2017 | Witt | B01D 29/012 |
| 9,845,583 | B1 | 12/2017 | Tsai | |
| 2001/0032846 | A1 | 10/2001 | Joshi et al. | |

(Continued)

FOREIGN PATENT DOCUMENTS

| | | |
|---|---|---|
| KR | 20090118296 | 11/2009 |
| KR | 101754778 | 7/2017 |

OTHER PUBLICATIONS

International Search Report/Written Opinion released by the U.S. Receiving Office as International Searching Authority dated Nov. 29, 2019 for corresponding International Application PCT/US2019/050567; 11 pages.

*Primary Examiner* — Frederick L Lagman
*Assistant Examiner* — Stacy N Lawson
(74) *Attorney, Agent, or Firm* — Smith Gambrell & Russell LLP

(57) ABSTRACT

An erosion control system of interconnected bags with water permeable fill material. The top panel of each bag is a geotextile mesh material so that water can pass into the bag and into the water permeable fill material. The bottom panel of each bag is a geotextile mesh that is non-degradable and slightly water permeable. The bags are connected in the end to form a trough through the permeable fill material.

10 Claims, 5 Drawing Sheets

(56) References Cited

U.S. PATENT DOCUMENTS

| | | | | |
|---|---|---|---|---|
| 2002/0090265 | A1 | 7/2002 | Merten | |
| 2006/0165320 | A1 | 7/2006 | Stephens | |
| 2007/0003369 | A1 | 1/2007 | Hanson et al. | |
| 2008/0080936 | A1 | 4/2008 | Quinley et al. | |
| 2011/0229275 | A1 | 9/2011 | Winings et al. | |
| 2017/0233969 | A1* | 8/2017 | Hawkinson | E02D 19/00<br>52/16 |
| 2019/0264414 | A1* | 8/2019 | Gregory, II | C02F 1/004 |

* cited by examiner

EROSION CONTROL SYSTEM

CLAIM OF PRIORITY

This application claims priority from U.S. Provisional Patent Application Ser. No. 62/730,237, filed on Sep. 12, 2018, which is incorporated herein in its entirety.

FIELD OF THE INVENTION

This invention generally relates to an erosion control system, and more particularly to an erosion control system of interconnected individual bags of geotextile material filled with a water permeable fill material.

BACKGROUND OF THE INVENTION

Downspouts from the gutters of a building create the potential for erosion at the site where the downspout discharges water onto the landscape around the building. Also, roofs without gutters at the eaves produce a drip line on the ground below that is subject to continuous erosion. Further, landscape runoff may produce erosion to the extent that gullies may be created in the landscape. In all three cases, the need to provide soil erosion control may extend over a long or short distance. Therefore, a need exists for an erosion control system that addresses the problems of soil erosion from downspout discharge, eaves runoff, and landscape runoff. Particularly, the need exists for erosion control system that is configurable to conform to the length required for control of the erosion.

SUMMARY OF THE INVENTION

The present invention addresses the need for an erosion control system that solves the problems of soil erosion from downspout discharge, eaves runoff, and landscape runoff. The present invention also is configurable to conform to the length required for erosion control.

Particularly, the erosion control system of the present invention includes a series of connected bags filled with a water permeable fill material including rock, gravel, sand, or other inorganic particle material. Each of the bags comprises a trough-shaped body formed by a mesh top panel and a bottom panel. The mesh top panel is joined to the bottom panel by means of upturn sides of the bottom panel folded over and sealed to the edges of the top panel. The bottom panel extends in the downstream direction beyond the top panel to create a dispersion flap for directing water from an upstream bag into a downstream bag or spread the water onto a landscape.

The top panel of each bag is a geotextile mesh material that is non-degradable and water permeable so that water can pass into the bag and into the water permeable fill material. The bottom panel of each bag is a geotextile material that is non-degradable and slightly water permeable so that the water passing into each bag of the erosion control system is directed to the downstream end of each bag in the series of bags and onto a dispersion flap with only a small amount of water soaking through the geotextile material of the bottom panel and into the surface of the landscape. Alternatively, the bottom panel could be a waterproof fabric, such as a plastic web.

The series of bags for the erosion control system includes an upstream lead bag and one or more downstream intermediate bags. The upstream lead bag has a permanently sealed upstream end and a releasably sealed downstream end. The upstream lead bag is filled with permeable fill material, and the downstream end is releasably sealed to prevent the fill material from spilling from the lead bag during shipping and handling. The upstream end of the lead bag is permanently sealed by any suitable method including sewing, gluing, or other means well known to those of ordinary skill in the art. The downstream end of the lead bag comprises an open end with the dispersion flap extending from the bottom panel in the downstream direction. The dispersion flap has a flat bottom panel and upturned sides. In addition, the downstream end of the lead bag has a foldable top connector strip attached to the inside of the top panel and a fixed bottom connector strip attached to the inside of the bottom panel and aligned with the foldable top connector strip. With the foldable top connector strip folded back into the interior of the lead bag, the foldable top connector strip aligns with and attaches to the fixed bottom connector strip to releasably seal the downstream end of the lead bag four shipping and handling.

The intermediate bag has a releasably sealed upstream end and a releasably sealed downstream end so that the fill material will not spill from the intermediate bag during shipping and handling. The upstream end of the intermediate bag has an interior top connector strip and an interior bottom strip for releasably closing the upstream end of the intermediate bag for shipping and handling. The downstream end of the intermediate bag is identical to the downstream end of the lead bag with an extending dispersion flap, a foldable top connector strip, and a fixed bottom connector strip as previously described.

In order to create the series of bags of the erosion control system, the lead bag is positioned at the source of the runoff, such as under a downspout. The lead bag is oriented with its sealed end upstream and its extending flap downstream. A first intermediate bag is then positioned downstream of the lead bag. The foldable connector strip of the lead bag is unfolded into its extended position. The flap of the lead bag is inserted into the upstream opening of the upstream end of the intermediate bag and telescoped into the intermediate bag until the unfolded connector strip of the lead bag aligns with and engages the interior top connector strip of the upstream end of the first intermediate bag. With the extending flap of the lead bag positioned within the first intermediate bag, the overlapping connection created between extending flap of the lead bag and the interior of the first intermediate bag assures that water passes from the lead bag to the first intermediate bag without the necessity of sealing the connection.

A second intermediate bag can be connected to the downstream end of the first intermediate bag in the same fashion as previously described with respect to the connection between the lead bag and the first intermediate bag. Once the final intermediate bag has been attached, the extending flap of the final intermediate bag serves as a dispersion flap to assure that the water ultimately spreads out onto the landscape as the water exits the erosion control system.

Further objects, features and advantages will become apparent upon consideration of the following detailed description of the invention when taken in conjunction with the drawings and the appended claims.

DETAILED DESCRIPTION OF THE PREFERRED EMBODIMENTS

Figure 1:
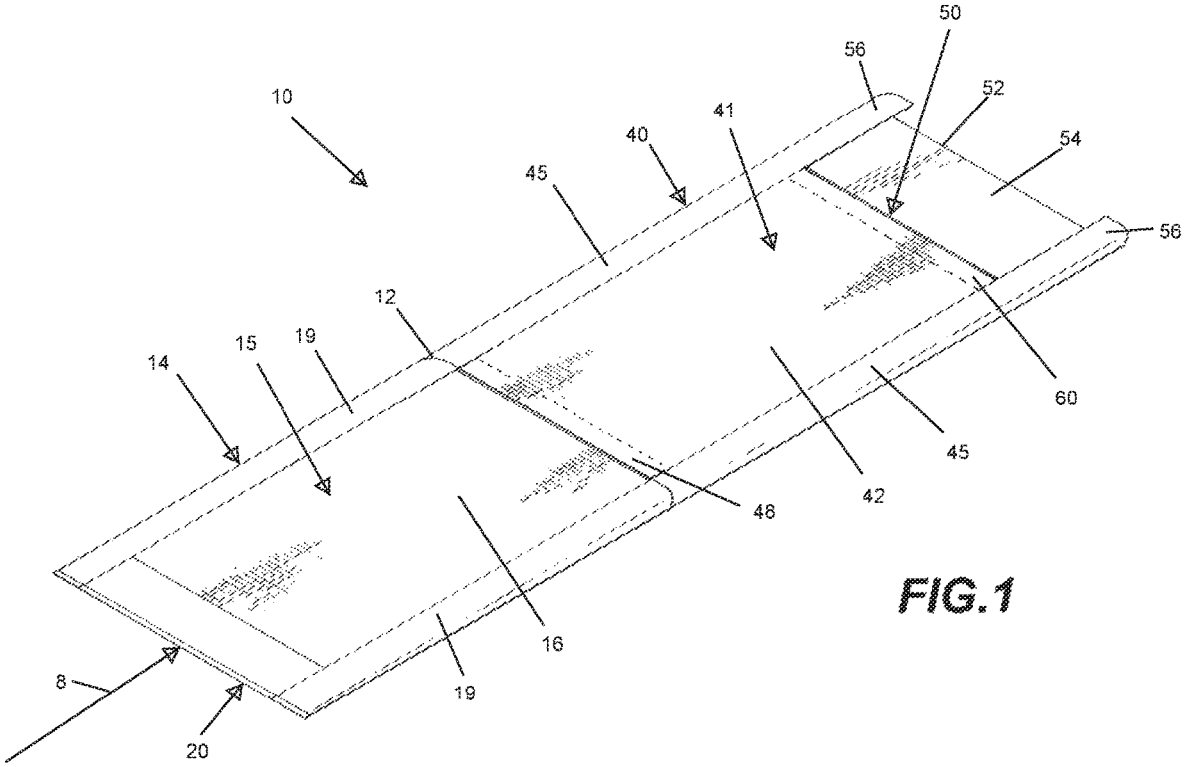
FIG. 1 is a top perspective view of an erosion control system in accordance with the present invention.
Figure 2:
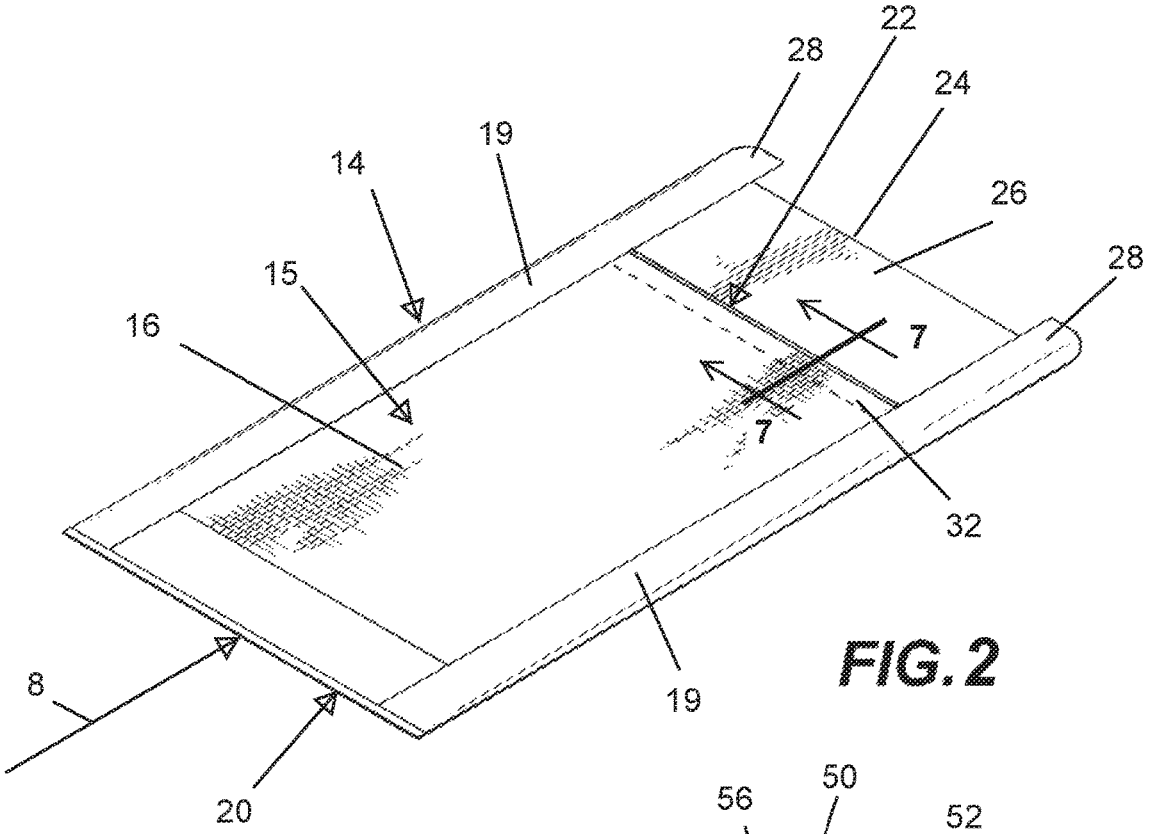
FIG. 2 is a perspective view of an upstream lead bag of the erosion control system in accordance with the present invention.
Figure 4:
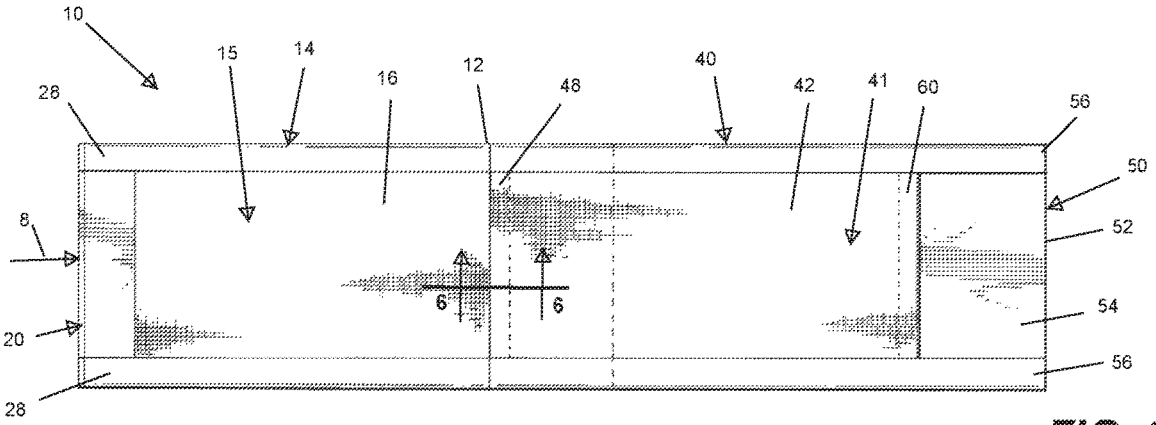
FIG. 4 is a top plan view of the erosion control system in accordance with the present invention.
Figure 9:
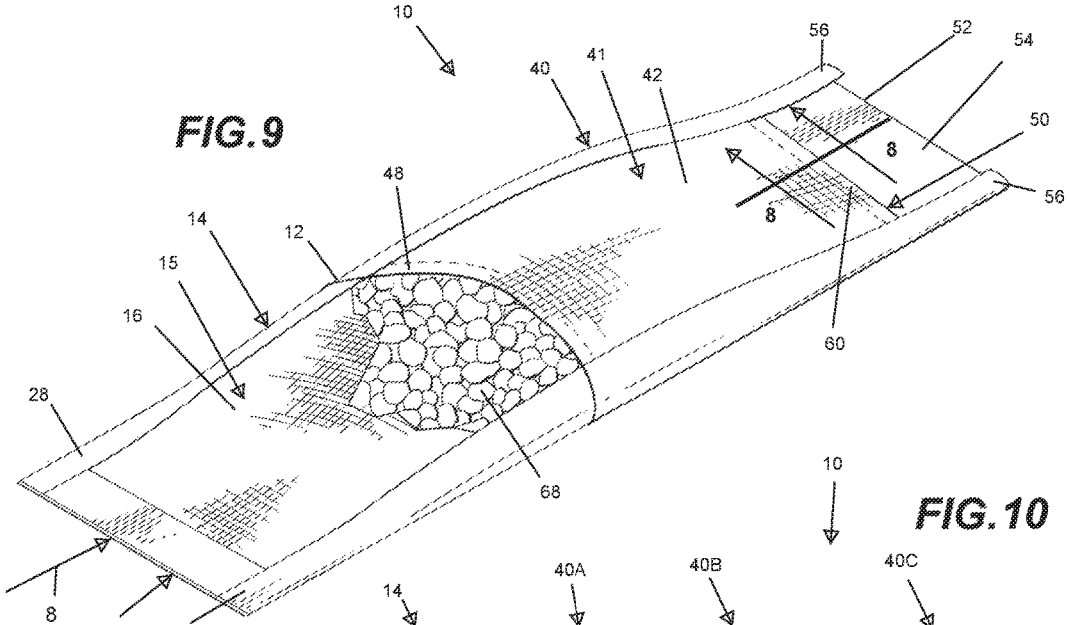
FIG. 9 is a top perspective view of the erosion control system with fill material (rock) in accordance with the present invention.

Referring to the drawings, FIG. 1 shows an erosion control system 10 including an upstream lead bag 14 and a downstream intermediate bag 40 connected together at connection 12. The arrow 8 shows the direction of water flow in the various figures. Turning to FIG. 2, the lead bag 14 includes a transversely enclosed trough-shaped body 15 formed by a mesh top panel 16 and a bottom panel 18 (FIG. 4). The mesh top panel 16 is joined to the bottom panel 18 by means of upturn sides 19 of the bottom panel 18 attached to the edges of the top panel 16. The mesh top panel 16 and the upturned sides 19 of the bottom panel 18 are joined in conventional fashion such as by sewing, gluing, or other attachment method known to those of ordinary skill in the art. The top panel 16 of each lead bag 14 is a geotextile mesh material that is non-degradable and water permeable so that water can easily pass into the lead bag 14 and into the water permeable fill material 68 contained within the transversely enclosed trough-shaped body 15 (FIG. 9). The bottom panel 18 is a geotextile material that is non-degradable and slightly water permeability so that the water passing into the lead bag 14 is directed to the downstream end 22 of the lead bag 14 and onto an extending flap 24 with only a small amount of water soaking through the geotextile material of the bottom panel 18 and onto the surface of the landscape.

The lead bag 14 has an upstream end 20 that is permanently sealed by means known to those of ordinary skill in the art. The lead bag 14 also has a downstream end 22 that is releasably sealed. Fill material 68 (FIG. 9), including rock, gravel, sand, or other inorganic particle material, is loaded into the trough-shaped body 15 of the lead bag 14, and the downstream end 22 is releasably sealed so that the fill material 68 does not spill from the lead bag 14 during shipping and handling.

Figure 7:
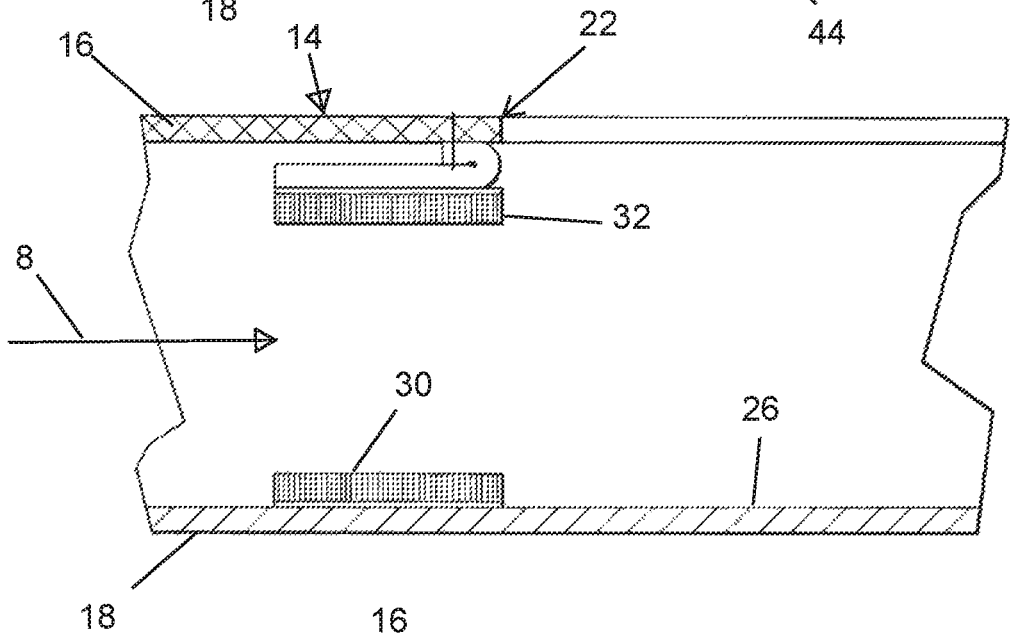
FIG. 7 is a section view of the erosion control system as seen along the line 7-7 of FIG. 2 in accordance with the present invention.
Figure 8:
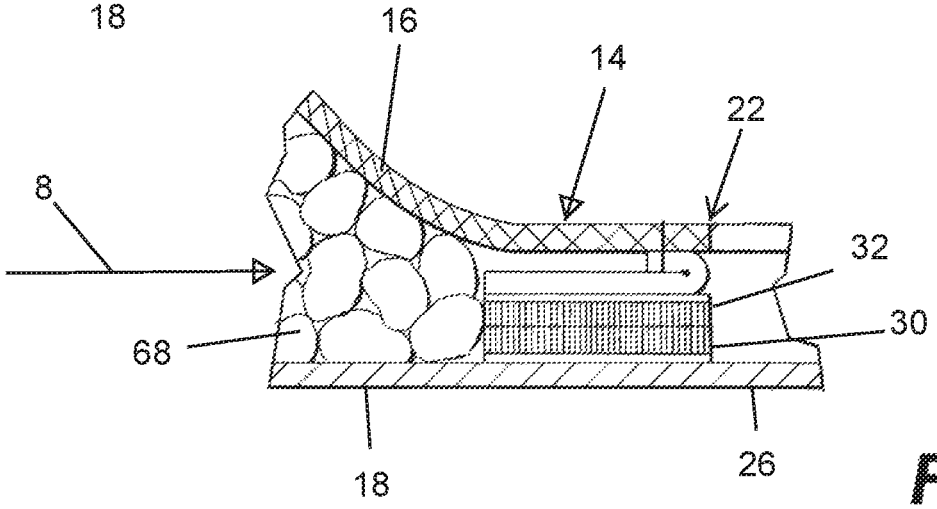
FIG. 8 is a section view of the erosion control system as seen along the line 8-8 of FIG. 9, with the downstream end of the bag closed in accordance with the present invention.

With reference to FIGS. 2 and 7, the downstream end 22 of the lead bag 14 has the downstream extending flap 24 with a bottom flap panel 26 and upturned sides 28 that form a trough. As best seen in FIG. 7, the downstream end 22 of the lead bag 14 has a foldable top connector strip 32 shown in the folded position with the top connector strip 32 within the interior of the lead bag 14. The top connector strip 32 is a releasable connector material such as releasable adhesive or a hook and loop fastener. The downstream end 22 of the lead bag 14 also has an interior fixed downstream bottom connector strip 30. FIG. 8 shows the downstream end 22 of the lead bag 14 releasably sealed by means of the top foldable top connector strip 32 engaging the fixed downstream bottom connector strip 30.

Figure 3:
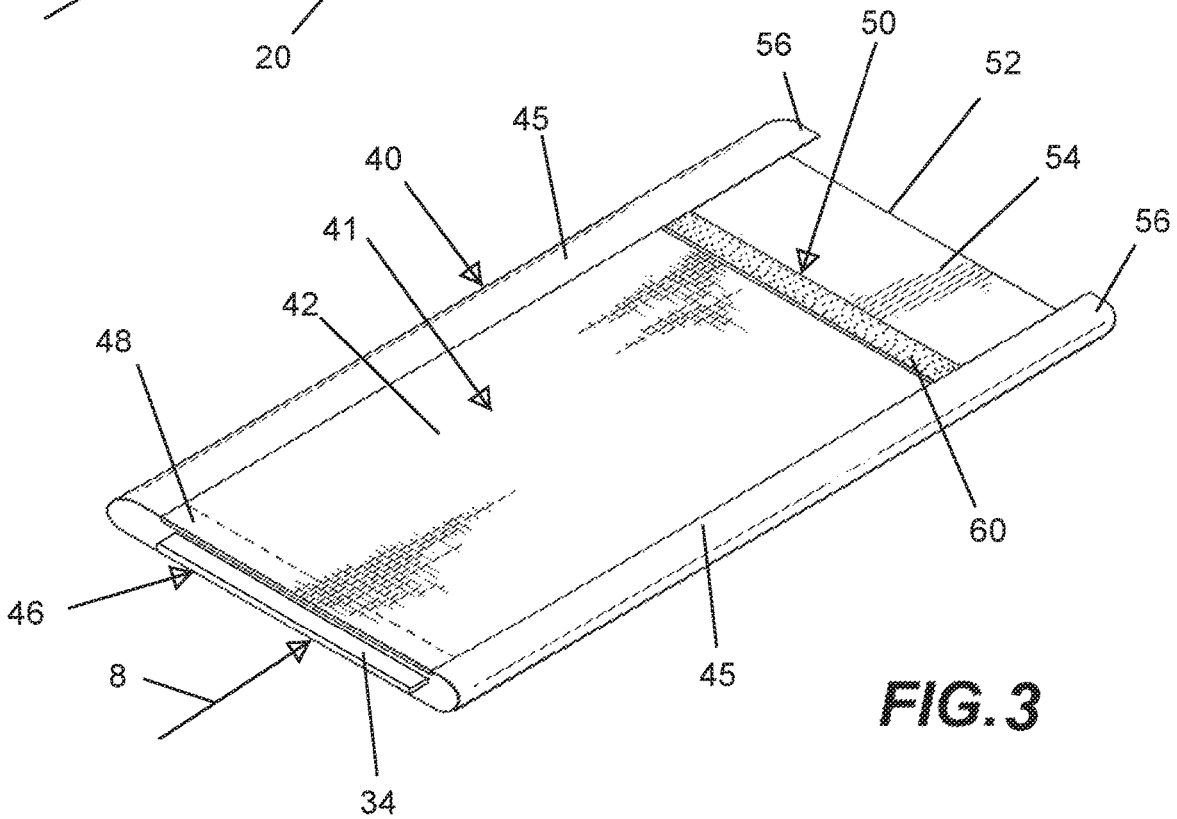
FIG. 3 is a perspective view of an intermediate bag of the erosion control system in accordance with the present invention.
Figure 5:
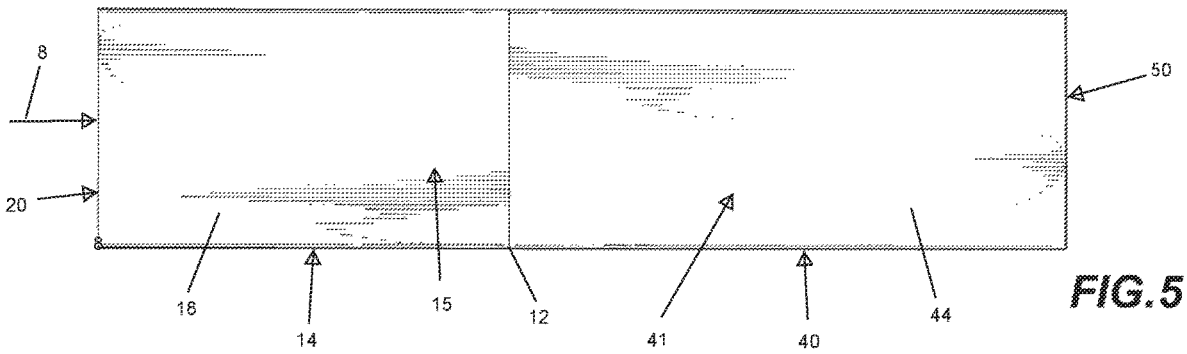
FIG. 5 is a bottom plan view of the erosion control system in accordance with the present invention.

Turning to FIG. 3, the intermediate bag 40 includes a transversely enclosed trough-shaped body 41 formed by a mesh top panel 42 and a bottom panel 44 (FIG. 5). The mesh top panel 42 is joined to the bottom panel 44 by means of upturn sides 45 of the bottom panel 44. Water permeable fill material 68 is contained within the transversely enclosed trough-shaped body 41 (FIG. 9). The mesh top panel 42 and the upturned sides 45 of the bottom panel 44 are joined in conventional fashion such as by sewing, gluing, or other attachment method known to those of ordinary skill in the art. The top panel 42 of each intermediate bag 40 is a geotextile mesh material that is non-degradable and water permeable so that water can easily pass into the intermediate bag 40 and into the water permeable fill material 68 (FIG. 9). The bottom panel 44 is a geotextile material that is non-degradable and slightly water permeability so that the water passing into the intermediate bag 40 is directed to the downstream end 50 of the intermediate bag 40 and onto an extending flap 52 with only a small amount of water soaking through the geotextile material of the bottom panel 44 and onto the surface of the landscape.

Figure 6:
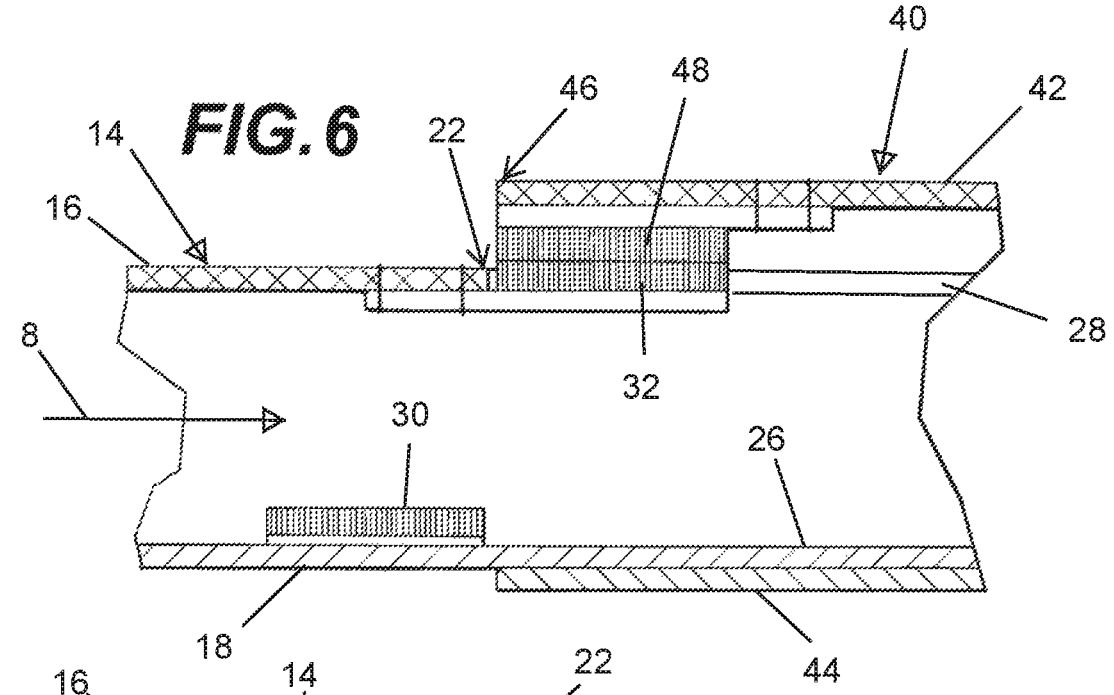
FIG. 6 is a section view of the erosion control system as seen along the line 6-6 of FIG. 4 in accordance with the present invention.

With reference to FIGS. 3 and 6, the upstream end 46 of the intermediate bag 40 has an interior top connector strip 48. The interior top connector strip 48 can be used to seal the upstream end 46 of the intermediate bag 40 by means of an aligned upstream bottom connector strip 34 on the interior of the bottom panel 44 for shipping and handling or to convert the intermediate bag 44 use as a lead bag 14. The connector strip 34 may be removable as shown in FIG. 6 where the space between flap 26 and fabric bottom panel 44 is not occupied by a connector strip thereby smoothing the water flow transition between bags. With continuing reference to FIG. 3, the downstream end 50 of the intermediate bag 40 is substantially the same as the downstream end of the lead bag 14. Fill material 68 (FIG. 9), including rock, gravel, sand, or other inorganic particle material, is loaded into the trough-shaped body 41 of intermediate bag 40, and the downstream end 50 is releasably sealed so that the fill material 68 does not spill from the intermediate bag 40 during shipping and handling.

With reference to FIG. 3, the downstream end 50 of the intermediate bag 40 has a downstream extending flap 52 with a flap bottom panel 54 and upturned sides 56. The downstream end 50 of the intermediate bag 40 has a foldable top connector strip 60 shown in the extended position with the top connector strip 60 outside the interior of the intermediate bag 40. The top connector strip 60 is a releasable connector material such as releasable adhesive or a hook and loop fastener. The downstream end 50 of the intermediate bag 40 also has a fixed interior bottom connector strip 30.

In order to create the series of bags of the erosion control 10 system, the lead bag 14 is positioned at the source of the runoff, such as under a downspout. The lead bag 14 is oriented with its sealed end 20 upstream and the flap 24 extending downstream. A first intermediate bag 40A (FIG. 10) is then positioned downstream of the lead bag 14. The foldable top connector strip 32 of the lead bag 14 is unfolded into its extended position shown in FIG. 6. The flap 24 of the lead bag 14 is inserted into the upstream end 46 of the intermediate bag 40A and telescoped into the intermediate bag 40A until the unfolded top connector strip 32 of the lead bag 14 aligns with and engages the interior top connector strip 48 of the first intermediate bag 40A. With the extending flap 24 of the lead bag 14 positioned within the first intermediate bag 40A, the overlapping connection created between flap 24 of the lead bag 14 and the interior of the first intermediate bag 40A assures that water passes from the lead bag 14 to the first intermediate bag 40A without the necessity of sealing the connection.

Figure 10:
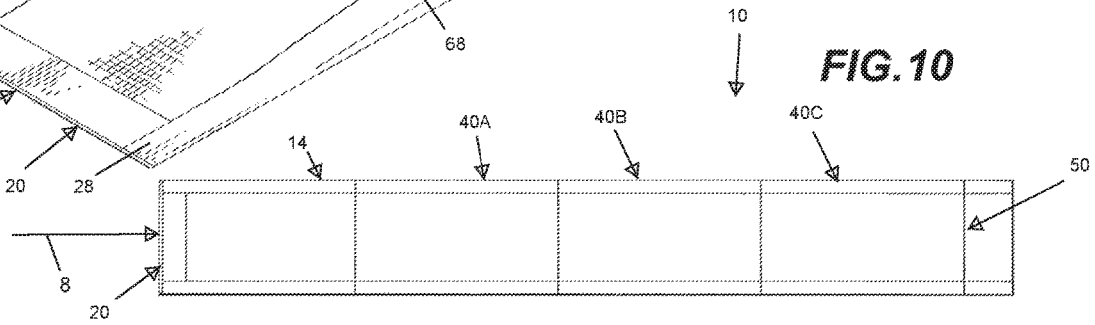
FIG. 10 is a top plan view of the erosion control system in accordance with the present invention.

With continuing reference to FIG. 10, a second intermediate bag 40B can be connected to the downstream end of the first intermediate bag 40A in the same fashion as previously described with respect to the connection between the lead bag 14 and the first intermediate bag 40A. Once the final intermediate bag, such as intermediate bag 40C, has been attached, the flap 52 of the final intermediate bag 40C serves as a dispersion element to assure that the water ultimately spreads out as it exits the erosion control system 10. The extending flap 52 of the final intermediate bag 40C can also be used to direct the water flow to a drain or away from the landscape altogether.

Because the upstream end 46 of the intermediate bag 40 can be releasably sealed by means of the connector 48 and the connector 34 (FIG. 3), the erosion control system 10 shown in FIG. 10 can be constructed by using only intermediate bags 40 and thereby eliminating the upstream lead bag 14. Alternatively, the upstream end 46 of the intermediate bag 40 can be permanently sealed on site to in effect creating the lead bag 14.

For the erosion control system 10, the top panels 16 and 42 of the bags 14 and 40 are a geotextile material that is non-degradable and water permeable so that water can easily pass into the bag and into the fill material 68 contained in the bags 14 and 40. The geotextile material for the top panels 16 and 42 may include an ultraviolet (UV) light stabilized high density polyethylene (HDPE) sold by Pak Unlimited, Inc., 185 Builders Parkway, Cornelia Ga. 30531 under the designation 70% Black Knit. The UV stabilized HDPE is an open woven mesh. The openings in the UV stabilized HDPE mesh are sufficiently large to allow the passage of water virtually uninhibited, but small enough so that the fill material 68 cannot pass through the mesh. The specifications for UV stabilized HDPE mesh is set forth in Table 1 below.

TABLE 1

| Typical Properties | Test Method | Units |
|---|---|---|
| Weight | AS 2001.2.13 | 7.4 oz/yd$^2$ |
| Tensile Strength | AS 2001.2.3 | Warp: 66 lbs.<br>Weft: 167 lbs. |
| Enlongation | AS 2001.2.3 | Warp: 60.8%<br>Weft: 54.7% |
| Tear Strength | AS 2001.2.10 | Warp: 25 lbs.<br>Weft: 44 lbs. |
| Burst Pressure | AS 2001.2.4 | 355 psi |
| Burst Strength | AS 2001.2.19 | 263 lbs. |
| Temperature Range | | 22° F. to +167° F. |
| Shade | | 64%-70% |

The bottom panels 18 and 44 and the extending flaps 24 and 52 of the bags 14 and 40 are a geotextile material that is non-degradable and slightly water permeable so that the water passing into the bags 14 and 40 is directed to the downstream end 50 of the bag 40C and onto the extending flap 52 with only a small amount of water soaking through the geotextile material onto the ground. The geotextile material for the bottom panels 18 and 44 and flaps 24 and 52 may include a woven clear HDPE scrim with a 1.75 mil vinyl coating on each side. Such geotextile material is sold by Pak Unlimited, Inc., 185 Builders Parkway, Cornelia Ga. 30531 under the designation 1212*c* (clear/clear). The vinyl coated scrim is essentially water impermeable, but in connection with the present invention has been perforated with less than 1% of the material open as a result of the perforations. The perforations are for the purpose of assuring that water does not stand for extended periods of time after a rainfall. Alternatively, the bottom panels 18 and 44 and the extending flaps 24 and 52 of the bags 14 and 40 could be waterproof without the perforations. The vinyl coated scrim has the specifications set forth in Table 2 below.

TABLE 2

| Typical Properties | Test Method | Units |
|---|---|---|
| Weight | | 6.7 oz/yd$^2$ |
| Tensile Strength (Grab Method) | ASTM D-5034 | Warp: 250 lbs.<br>Fill: 230 lbs. |
| Tongue Tear | ASTM D-2261 | Warp: 75 lbs.<br>Fill: 75 lbs. |
| Accelerated UV Weathering @ 2000 hrs. | ASTM G-53 | >90% |
| Mullen Burst | ASTM D-3786 | 470 psi |

The fill material 68 for the bags 14 and 40 comprises rock, gravel, sand, or other inorganic particle material. Any suitable fill material can be used as long as the fill material is stable, is water permeable, and is unaffected by the presence of water. Further, the fill material 68 can be a decorative stone or other inorganic particle material to enhance the appearance of the landscape.

While this invention has been described with reference to preferred embodiments thereof, it is to be understood that variations and modifications can be affected within the spirit and scope of the invention as described herein and as described in the appended claims.

I claim:

1. An erosion control system comprising a series of interconnected bags, the series of bags comprising:

a. a lead bag of the series of bags having a lead transversely enclosed body with a lead bag length, the lead body including:
   i. a lead water permeable top panel having a lead panel length;
   ii. a lead bottom panel attached to the lead top panel along the length of the lead body;
   iii. a lead closed upstream end of the lead bag; and
   iv. a lead open downstream end of the lead bag; the lead bag further having a lead flap extending downstream from the lead bottom panel and extending beyond the lead panel length of the lead water permeable top panel;

b. an intermediate bag of the series of bags having an intermediate transversely enclosed body with an intermediate bag length, the intermediate body including:
   i. an intermediate water permeable top panel having an intermediate panel length;
   ii. an intermediate bottom panel attached to the intermediate top panel along the length of the intermediate body;
   iii. an intermediate open upstream end of the intermediate bag; and
   iv. an intermediate open downstream end of the intermediate bag; the intermediate bag further having an intermediate flap extending downstream from the intermediate bottom panel and extending beyond the intermediate panel length of the intermediate water permeable top panel;

wherein the lead bag is connected to the intermediate bag by inserting the downstream end of the lead bag, including the lead flap, into the intermediate open upstream end of the intermediate bag.

2. The erosion control system of claim 1 wherein the intermediate upstream end of the intermediate bag has an intermediate interior top connector strip and the intermediate downstream end of the intermediate bag has an intermediate downstream bottom connector strip and an intermediate foldable top connector strip and the lead open downstream end of the lead bag has a lead foldable top connector strip and a lead downstream bottom connector strip, and wherein when the lead downstream end of the lead bag is inserted into the intermediate upstream end of the intermediate bag, the intermediate interior top connector strip of the intermediate bag connects to the lead foldable top connector strip of the lead bag when the lead foldable top connector strip is in its unfolded position.

3. The erosion control system of claim 2, wherein the intermediate downstream end of the intermediate bag is releasably sealed by connecting the intermediate foldable top connector strip, in its folded position, to the intermediate downstream bottom connector strip.

4. The erosion control system of claim 1, wherein the lead upstream end of the lead bag is permanently sealed.

5. The erosion control system of claim 1, wherein the lead upstream end of the lead bag is releasably sealed.

6. The corrosion control system of claim 1, wherein the water permeable top panel of the transversely enclosed body of either the lead bag or the intermediate bag is a mesh top panel joined to the respective bottom panel by means of upturned sides of the bottom panel.

7. The erosion control system of claim 6, wherein the mesh top panel is a geotextile mesh comprising an ultraviolet light stabilized high density polyethylene with openings that are sufficiently large to allow the passage of water substantially uninhibited but small enough so that particle fill material cannot pass through.

8. The erosion control system of claim 6, wherein the respective bottom panel is a geotextile material that is non-degradable and water permeable as a result of perforations that produce material openings of less than 1% of the area of the bottom panel.

9. The erosion control system of claim 1, wherein the enclosed body of either the lead bag or the intermediate bag is filled with a water permeable fill material.

10. The erosion control system of claim 9, wherein the water permeable fill material is an inorganic particle material.

* * * * *